US007055574B2

(12) United States Patent
Strangman et al.

(10) Patent No.: US 7,055,574 B2
(45) Date of Patent: Jun. 6, 2006

(54) METHOD OF PRODUCING METAL ARTICLE HAVING INTERNAL PASSAGE COATED WITH A CERAMIC COATING

(75) Inventors: Thomas E. Strangman, Prescott, AZ (US); Udo K. Schuelke, Mesa, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/899,577

(22) Filed: Jul. 27, 2004

(65) Prior Publication Data

US 2006/0021731 A1 Feb. 2, 2006

(51) Int. Cl.
*B22C 3/00* (2006.01)
*B22C 9/10* (2006.01)

(52) U.S. Cl. ..... 164/138; 164/28; 164/369

(58) Field of Classification Search ..... 164/28, 164/138, 72, 74, 351, 365, 369
See application file for complete search history.

(56) References Cited

U.S. PATENT DOCUMENTS

2004/0244936 A1* 12/2004 Jahedi et al. ..... 164/72

FOREIGN PATENT DOCUMENTS

| | | | |
|---|---|---|---|
| DE | 10028160 C2 | | 3/2003 |
| JP | 57-62851 | * | 4/1982 |
| JP | 62-110833 | * | 5/1987 |
| JP | 64-15266 | * | 1/1989 |
| JP | 2-108447 | * | 4/1990 |
| WO | WO 01/94754 A1 | | 12/2001 |

* cited by examiner

*Primary Examiner*—Kuang Y. Lin
(74) *Attorney, Agent, or Firm*—Chris James

(57) ABSTRACT

The present application relates to a method of producing a metal article having an internal passage coated with a ceramic coating. The method comprises: preparing a core for defining the internal passage; applying the ceramic coating on the core; assembling the core with the ceramic coating applied thereon into a mold; casting metal into the mold at a pour temperature lower than the melting temperature of the ceramic coating; and removing the core. The ceramic coating may be applied by plasma spraying or slurry deposition.

11 Claims, 3 Drawing Sheets

METHOD OF PRODUCING METAL ARTICLE HAVING INTERNAL PASSAGE COATED WITH A CERAMIC COATING

TECHNICAL FIELD

This invention relates generally to a method of providing a ceramic coating to a metal article and in particular to a method of producing a metal article having an internal passage coated with a ceramic coating acting as a thermal barrier.

BACKGROUND OF THE INVENTION

In certain technical fields such as gas turbine engine technology or combustor technology where the engines or combustors are required to be more efficient, temperatures within the engine or combustor have continued to rise. However, in order to maintain the ability to operate at these increasing temperatures, the metal components of the engine or combustor which are directly exposed to the increased temperatures have been protected by a thermal barrier coating (TBC) having a ceramic layer which insulates the components.

Typically, the thermal barrier coating includes a ceramic top coat made of stabilized zirconia and disposed on an aluminide or MCrAlY bond coat, with M selected from a group consisting of iron, cobalt, nickel, and mixtures thereof.

The ceramic top coat may have a columnar grain microstructure for allowing the columnar grains to expand and contract without developing stresses that could cause spalling.

The ceramic top coat is usually applied by electron-beam physical vapor deposition (EB-PVD) or plasma spraying, two coating processes which require a certain distance between the substrate to be coated and the source of ceramic material. In other words, it is difficult to apply EB-PVD or plasma sprayed coatings to a metal article having a narrow or complicated internal passage to be coated with the ceramic coating.

SUMMARY OF THE INVENTION

An object of the present invention is to provide a method of producing a metal article having an internal passage coated with a ceramic coating acting as a thermal barrier.

According to a first aspect of the invention, the above object is achieved by the following steps: preparing a core for defining the internal passage of the metal article; applying the ceramic coating on the core; assembling the core with the ceramic coating applied thereon into a mold; casting metal into the mold at a pour temperature lower than the melting temperature of the ceramic coating; and removing the core.

As compared with a conventional technique, in the method according to the first aspect of the present invention the ceramic coating is not deposited on the base metal of the metal article but the base metal is provided to the ceramic coating by casting. Since the outer surface of the core is more readily accessible than the internal passage of a finished metal article, the ceramic coating can be applied on the core without difficulty.

The step of applying the ceramic coating may be performed by a thermal spraying process of which plasma spraying, flame spraying and HVOF (high velocity oxy fuel) are examples. Alternatively, the step of applying the ceramic coating may be performed by a slurry deposition process.

The ceramic coating may comprise stabilized zirconia, stabilized hafnia, alumina, or zircon (zirconium silicate). Zirconia and hafnia may be stabilized with yttria or the like, thus including stabilized tetragonal and cubic zirconia and stabilized tetragonal and cubic hafnia, respectively.

Optionally, the ceramic coating is strengthened after removing the core by infiltrating colloidal or sol gel zirconia, alumina or silica. The infiltrated zirconia, alumina or silica may densify the ceramic coating or stabilize the microcrack distribution within the thermal barrier coating layer.

Further, the method according to the invention may comprise a step of applying a metallic or intermetallic coating on the ceramic coating prior to casting so as to improve bonding between the ceramic coating and the metal casting. The metallic or intermetallic coating is not required when the composition of the cast metal has sufficient aluminum or chromium to form and maintain a stable, adherent oxidation resistant chromium or aluminum oxide scale at the interface of the ceramic coating and the cast metal. In particular, components with low metal temperatures in the service environment may not require a metallic or intermetallic coating to achieve an adherent ceramic coating. The metallic or intermetallic coating may contain one or more of Al, Cr, Y, Si, Hf, Ni, Co, and Fe. For example, the bond coat may be an MCrAlY bond coat (M: Fe, Co, Ni, or mixtures thereof) or an aluminide bond coat such as nickel, cobalt or iron aluminide. An MCrAlY or aluminide bond coat is capable of forming a highly adherent aluminum oxide scale which improves bonding to the ceramic coating.

Preferably, the core is a resin-bonded sand core or a graphite core, which is removed by oxidation.

Optionally, a temporary coating is applied on the core before applying the ceramic coating. In this case the removal step includes removing both the core and the temporary coating. The temporary coating may comprise Mo or MoC for preventing sticking of the ceramic coating to the core when removing the core. Mo and MoC can be removed by air heat treatment after casting.

Alternatively, the core may be replaced before casting. To be more specific, first a core pattern for defining the internal passage is prepared and the ceramic coating is applied on the core pattern, then the core pattern is removed and the free-standing ceramic coating is filled with the core material to be used in the casting step. The core pattern may comprise wax, plastic, or styrofoam, which can be easily removed by exposure to a high temperature oxidizing environment. The core material to be used in the casting step may be sand or another ceramic powder, which can be easily poured from the internal passage after the casting step.

Depending on the use of the metal article, the cast metal may comprise stainless steel, or a nickel, cobalt or iron based super alloy, or an aluminum alloy when exposure to hot gases is of short duration.

The metal article may be a turbine housing unit for a turbocharger of an internal combustion engine, a combustion chamber of a combustor such as a small pipe combustor, a duct for hot gases, or a rocket nozzle or thruster.

According to a second aspect of the invention, there is provided a method of producing a metal article having an internal passage coated with a ceramic coating acting as a thermal barrier, the method comprising the following steps: preparing a resin-bonded sand core for defining the internal passage; applying the ceramic coating by plasma spraying stabilized zirconia onto the sand core; assembling the coated sand core into a mold; casting stainless steel into the mold at a pour temperature lower than the melting temperature of the ceramic coating; and oxidizing the resin binder of the sand core, followed by removing the sand core.

If need be, the ceramic coating is coated with a metallic or intermetallic alloy containing one or more of Al, Cr, Y, Si, Hf, Ni, Co, and Fe prior to casting to improve bonding between the ceramic coating and the metal casting.

Optionally, the method according to the second aspect of the invention comprises a step of plasma spraying Mo or MoC onto the sand core before applying the ceramic coating to provide a temporary coating for preventing sticking of the stabilized zirconia to the sand core when removing the sand core. The temporary coating is removed as gaseous oxides in the step of oxidizing the resin binder of the sand core.

Further, the ceramic coating can be strengthened after removing the sand core by infiltrating colloidal or sol gel zirconia, alumina or silica.

According to a third aspect of the invention, there is provided a method of producing a metal article having an internal passage coated with a ceramic coating acting as a thermal barrier, the method comprising the following steps: preparing a resin-bonded sand core for defining the internal passage; sealing surface porosity in the sand core with a film such as lacquer; applying the ceramic coating by depositing, on the sealed sand core, a ceramic slurry comprised of powder particles of stabilized zirconia, stabilized hafnia, zircon or alumina and a binder comprised of colloidal or sol gel silica or alumina; drying and degassing the coated sand core; assembling the dried and degassed sand core into a mold; casting stainless steel into the mold at a pour temperature lower than the melting temperature of the ceramic coating; and oxidizing the resin binder of the sand core, followed by removing the sand core.

If need be, the dried ceramic coating is coated with a metallic or intermetallic alloy containing one or more of Al, Cr, Y, Si, Hf, Ni, Co, and Fe prior to casting to improve bonding between the ceramic coating and the metal casting.

Optionally, the ceramic coating is strengthened after removing the sand core by infiltrating colloidal or sol gel zirconia, alumina or silica.

By using the production method according the first, second or third aspect of the invention, a novel metal article such as a turbine housing unit for a turbocharger of an internal combustion engine can be obtained, comprising a single-piece metallic casting and a ceramic coating on internal surfaces lacking line-of-sight visibility to the exterior. Such a coated metal article cannot be obtained by a conventional method where the ceramic coating is applied to an internal passage of a finished metal casting, because the conventional method requires that all of the internal surfaces are readily accessible or have line-of-sight visibility to the exterior.

DESCRIPTION OF THE PREFERRED EMBODIMENTS

The metal article contemplated by the present invention is exemplified by a turbine housing unit for a turbocharger of an internal combustion engine.

Figure 1:
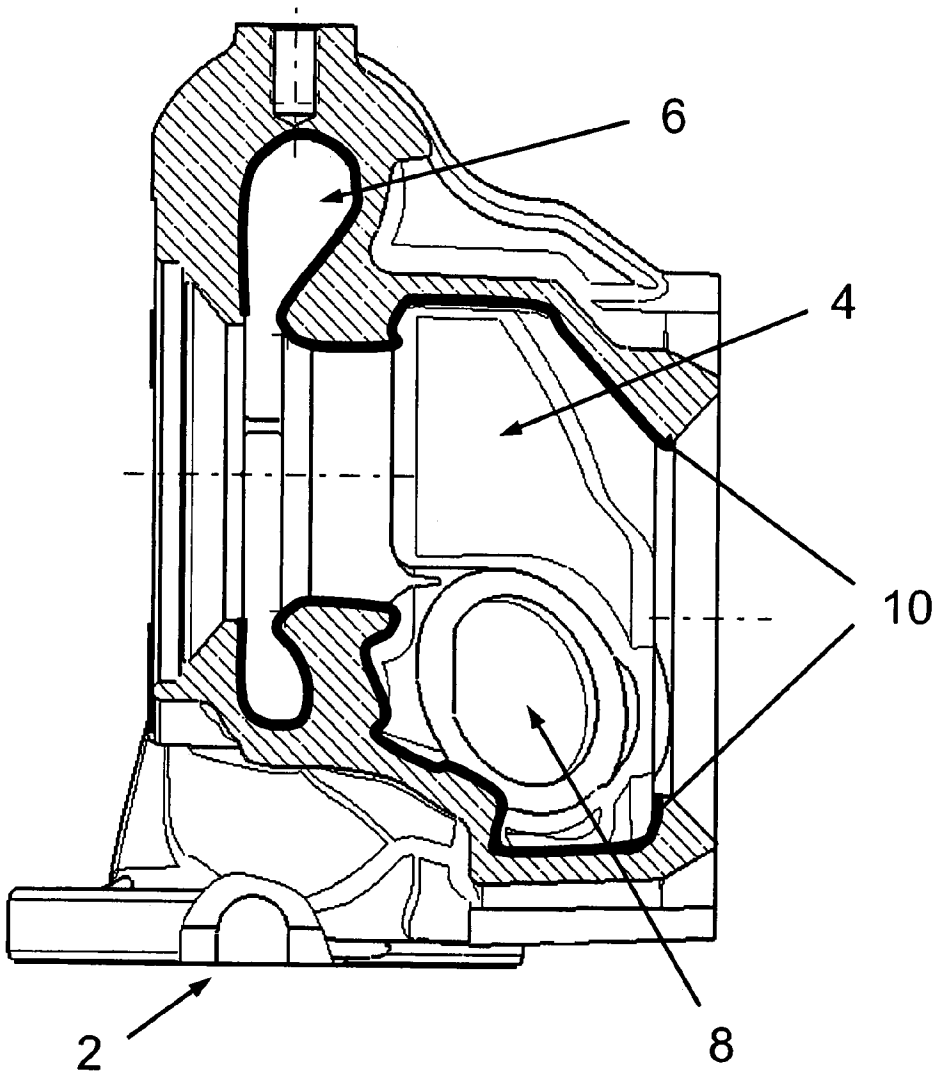
FIG. 1 is a cross-sectional view of a turbine housing unit for a turbocharger, representing a metal article as contemplated by the present invention.

Referring to FIG. 1, it will be seen that there is provided a turbine housing unit which has an internal passage comprising an inlet 2, an outlet 4, and a volute 6 having a single scroll configuration for receiving a turbine wheel. If installed in an exhaust system of an internal combustion engine, the internal passage guides exhaust gas discharged from the internal combustion engine from the inlet 2 into driving communication with a turbine wheel in the volute 6 prior to discharge through the outlet 4.

The internal passage further comprises a waste gate 8 at the inlet 2 which communicates the inlet 2 with the outlet 4 to bypass the turbine wheel in the volute 6 and to waste-gate excess exhaust gas to the outlet 4.

As designated by the thick continuous line 10 in FIG. 1, the inner wall surfaces of the outlet 4 and the volute 6 are covered with a ceramic coating. Although not shown, the inner wall surfaces of the inlet 2 and the waste gate 8 are covered by the ceramic coating 10 as well. In other words, all of the internal passage of the turbine housing unit is coated with the ceramic coating 10.

While the turbine housing unit is made of cast stainless steel, the ceramic coating 10 is a thermal barrier coating including a ceramic top coat of yttria stabilized zirconia and a NiCrAlY bond coat. The thickness of the bond coat is 50 to 150 μm, and the thickness of the ceramic layer may vary in the 100 to 1500 μm range. There may be interposed a sub-micron thick alumina scale on the bond coat which improves the bonding of the ceramic top coat to the bond coat. The ceramic top coat may have a bond strength as high as 50 MPa, which is considered to be robust in the operation of the turbocharger.

In the following, there will be discussed two embodiments for producing the turbine housing unit shown in FIG. 1. Both embodiments use a sand casting technique for producing the turbine housing unit, and they differ mainly in that the ceramic top coat of the thermal barrier coating is prepared on the one hand by plasma spraying and on the other hand by slurry deposition.

First Embodiment

Figure 2:
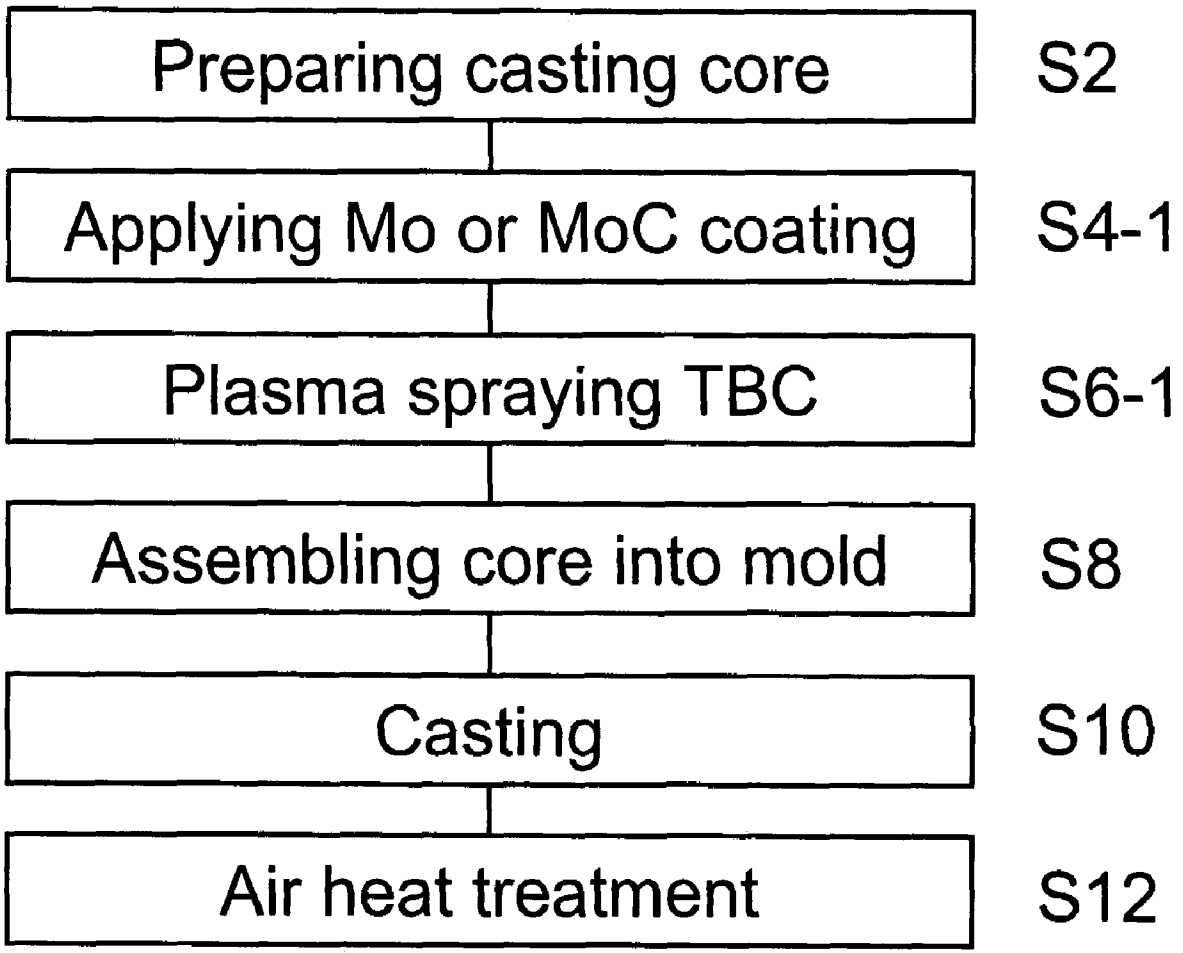
FIG. 2 is a flow chart showing a method for producing the turbine housing unit shown in FIG. 1 according to a first preferred embodiment of the invention.

As shown in the flow chart of FIG. 2, in a first step S2 a sand core is prepared which is an approximate duplicate of the internal passage of the turbine housing unit. The core sand is bonded by a carbonaceous resin to impart strength and plasticity to the sand core.

In a subsequent step S4-1, a temporary coating of Mo or MoC is plasma sprayed onto the sand core to provide a smooth layer having a thickness of about 15 μm which facilitates release of the sand core from the thermal barrier coating after casting. Both Mo and MoC are removed as gaseous oxides when exposed to a hot air environment above 600° C. Consequently, the presence of a thin Mo or MoC layer may prevent sticking of the thermal barrier coating to the surface of the sand core when removing the sand core.

In a subsequent step S6-1, a thermal barrier coating is applied onto the coated sand core. The thermal barrier coating is prepared by plasma spraying about 250 μm of yttria stabilized zirconia as a ceramic top coat onto the coated sand core, followed by plasma spraying about 100 μm of NiCrAlY alloy, which consists of about 31 wt % Cr, 11 wt % Al, 0.5 wt % Y, and the balance Ni and unavoidable impurities. In order to inhibit thermal stress cracking of the sand core during coating, the surface of the core is liberally air cooled. Low power plasma spray guns are also preferred to minimize heat input into the sand core during coating.

Then, in step S8 the coated sand core having the thermal barrier coating applied thereon is assembled into a mold which is an approximate duplicate of the outside of the turbine housing unit.

Subsequently, in step S10 stainless steel is poured into the mold at a temperature sufficient to interdiffuse the bond coat of the thermal barrier coating with the contact surface of the stainless steel casting during solidification. For casting the stainless steel alloy HK30 can be used. This alloy is a FeCrNi steel consisting of 0.25–0.35 wt % C, 0.75–1.75 wt % Si, 23–27 wt % Cr, 19–22 wt % Ni, 1.2–1.5 wt % Nb, balance Fe and unavoidable impurities such as Mn, P, S, Mo.

The yttria stabilized zirconia may develop a network of cracks during casting or cooling. Segmentation cracking of the zirconia is desirable if it does not result in spalling, because the network of cracks can accommodate thermal strains occurring within the plane of the zirconia coating during in a thermal cycle.

Finally, in step S12 an air heat treatment is performed at above 450° C. to oxidize the resin binder of the sand core. The heat treatment temperature should be increased to above 600° C. to remove the Mo or MoC layer as gaseous oxides. Following this heat treatment, the sand may be removed by pouring it out of the casting. Depending upon the size and complexity of the sand core and the heat treatment temperature, the duration of the air heat treatment may be 0.5 to 5 hours.

It is to be noted that step S4-1 of applying the Mo or MoC layer is optional. If the properties of the sand core and the yttria stabilized zirconia layer of the thermal barrier coating are such that there is no problem with sticking of the zirconia layer to the surface of the sand core when removing the sand core, the Mo or MoC layer can be omitted.

Although not shown in FIG. 2, the thermal barrier coating can be strengthened after removal of the sand core and cleaning of the internal passage of the turbine housing unit by infiltrating colloidal or sol gel zirconia, alumina or silica. The turbine housing unit is preferably oven dried in the 100° C. to 600° C. range to remove moisture from the infiltrated thermal barrier coating.

Second Embodiment

Figure 3:
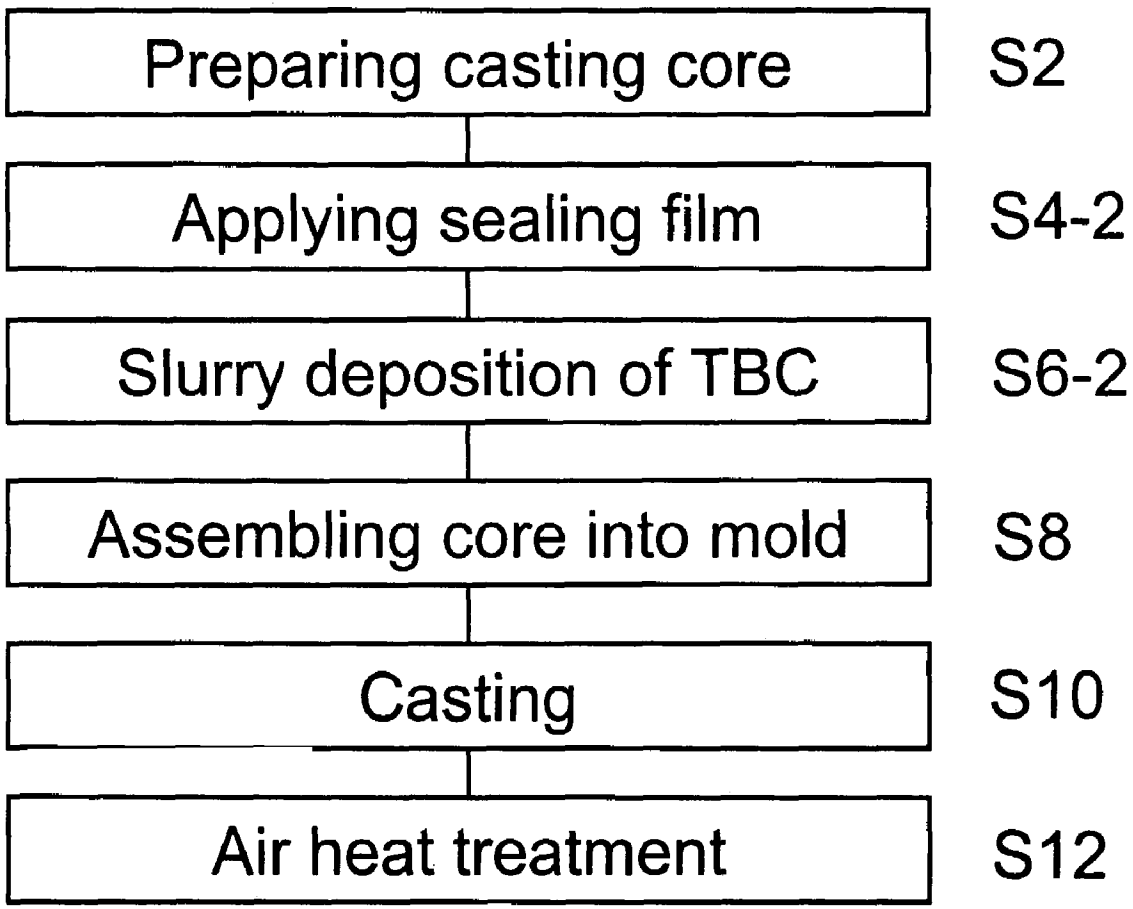
FIG. 3 is a flow chart showing a method for producing the turbine housing unit shown in FIG. 1 according to a second preferred embodiment of the invention.

In FIG. 3, in which like reference signs designate process steps similar to those of the first embodiment, a flow chart of a second embodiment of the method of producing the turbine housing unit shown in FIG. 1 is illustrated.

The second embodiment differs from the first embodiment in that a different temporary coating is applied to the sand core and in that slurry deposition is used in preparing the thermal barrier coating. The following description focuses on the differences. For a detailed discussion of the other steps, it is referred to the first embodiment.

After the resin-bonded sand core has been prepared, in step S4-2 a thin layer of a material such as lacquer is applied onto the sand core to seal surface porosity in the sand core.

In step S6-2, the thermal barrier coating is applied on the sealed sand core by using a slurry deposition technique which is similar to making a shell mold used for investment casting. First, a ceramic top coat is applied by coating the sand core with a wet slurry comprising fine (less than 20 μm) yttria stabilized zirconia powder and a binder phase such as colloidal silica or alumina, or sol gel silica or alumina. While the slurry is still wet, coarse (more than 20 μm) yttria stabilized zirconia powder is deposited onto the slurry-wetted sand core to add strength and thickness to the coating. After the slurry has been dried, one or more additional layers may be added to the coating by repeating the process. The zirconia coating is deposited with a total thickness of about 100 to 1000 μm. After deposition and drying of the ceramic thermal barrier coating layer has been completed, the coated sand core is oven dried in the 100 to 250° C. range to remove moisture. After moisture has been evaporated from the sand core and the ceramic top coat, a NiCrAlY bond coat is applied with a thickness range of about 25 to 200 μm by plasma spraying or another suitable process.

Thereafter, the core is inserted into the mold and casting follows.

Similar to the first embodiment, the ceramic top coat of the thermal barrier coating can be strengthened by infiltrating colloidal or sol gel zirconia, alumina or silica after removal of the sand core and cleaning of the internal passage of the turbine housing unit.

(Modifications)

As a matter of course, the invention can be realized in a way other than illustrated in the above first and second embodiments.

For example, the invention is not limited to producing a turbine housing unit, but may be applied to other metal articles having an internal passage which is to be protected with a ceramic coating. Such metal articles include a combustion chamber, a duct for hot gases, or a rocket nozzle or thruster. It goes without saying that the invention is particularly effective if the internal passage is narrow or has a complicated shape including internal surfaces lacking line-of-sight visibility to the exterior. This is because it is easier to apply the ceramic coating onto the core than applying the ceramic coating to the internal passage of the cast metal article.

In addition to plasma spraying the ceramic and metallic layers of the coating system, other thermal and metal spray processes, such as high velocity oxy-fuel (HVOF), and very high velocity, low temperature (cold spray) processes are considered within the scope of the invention as methods for deposition of the coating.

Further, the thermal barrier coating is not limited to the compositions discussed in the first and second embodiments. For example, the NiCrAlY bond coat can be replaced with another high-melting-temperature, oxidation-resistant metallic or intermetallic bond coat containing one or more of Al, Cr, Y, Si, Hf, Ni, Co, and Fe. Also, ceramic top coats other than those discussed above can be used such as yttria stabilized hafnia or yttria stabilized ceria. Finally, stabilizers other than yttria ($Y_2O_3$) may be used to stabilize zirconia or hafnia, such as CaO, MgO, $Sc_2O_3$, and rare earth oxides of La, Ce, Nd, Gd, Yb, Lu.

Further, it possible to apply a ceramic coating made of alumina or zircon which, unlike stabilized zirconia, does not develop a columnar grain microstructure, or to omit the metallic or intermetallic bond coat if the bonding strength between the ceramic coating and the cast metal is sufficiently high. In the latter case, the pour temperature of the cast metal must be sufficient to directly bond the cast metal to the ceramic coating.

Still further, a cast metal other than stainless steel can be used. For example, nickel, cobalt or iron based superalloys are well used in connection with thermal barrier coatings. However, other castings such as aluminum alloy castings may be suitable as well depending on the use of the metal article.

Finally, the core is not limited to a resin-bonded sand core provided that the core can be readily coated with the ceramic coating or the intermediate temporary coating and that the core can be readily removed after casting. For example, a core made from graphite may be used.

Aside from using the same core material for defining the internal passage and for performing casting, different core materials may be used. First, a core pattern is prepared from one core material and the ceramic coating is applied on the core pattern. Then, the core pattern is removed and the free-standing ceramic coating is filled with the other core material for the casting step. Suitable materials for the core pattern include wax, plastic or styrofoam, which can be easily removed by exposure to a high temperature oxidizing environment, while suitable core materials for the casting step include sand and other ceramic powders, which can be easily removed after casting by pouring them from the internal passage.

Apart from the above modifications, various other modifications and alterations will be apparent to those skilled in the art. Accordingly, this description of the invention should be considered exemplary, not as limiting the scope of the invention set forth in the following claims.

The invention claimed is:

1. A method of producing a metal article having an internal passage coated with a ceramic layer acting as a thermal barrier, said method comprising the following steps:

preparing a core for defining the internal passage;

applying the ceramic coating on the core;

assembling the core with the ceramic coating applied thereon into a mold;

casting metal into the mold at a pour temperature lower than the melting temperature of the ceramic coating;

removing the core; and strengthening the ceramic coating after the removal step by infiltrating the coating with colloidal or sol gel zirconia, alumina, or silica.

2. A method according to claim 1, wherein the step of applying the ceramic coating is performed by a thermal spray process.

3. A method according to claim 1, wherein the step of applying the ceramic coating is performed by a slurry deposition process.

4. A method according to claim 1, wherein the ceramic coating comprises stabilized zirconia, stabilized hafnia, alumina, or zircon.

5. A method according to claim 1, further comprising a step of applying a metallic or intermetallic coating on the ceramic coating prior to casting.

6. A method according to claim 5, wherein the metallic or intermetallic coating contains one or more of Al, Cr, Y, Si, Hf, Co, and Fe.

7. A method according to claim 1, wherein the core is a resin-bonded sand core or a graphite core which is removed by oxidation.

8. A method according to claim 1 or 7, wherein a temporary coating is applied on the core before applying the ceramic coating, and wherein the removal step includes removing both the core and the temporary coating.

9. A method of producing a metal article having an internal passage coated with a ceramic layer acting as a thermal barrier, said method comprising the following steps:

preparing a core for defining the internal passage:

applying a temporary coating of Mo or MoC onto the core;

applying the ceramic coating onto the temporary coating on the core;

assembling the core with the temporary and ceramic coatings applied thereon into a mold;

casting metal into the mold at a pour temperature lower than the melting temperature of the ceramic coating; and removing the core and the temporary coating.

10. A method according to claim 1, wherein the cast metal comprises stainless steel, or a nickel, cobalt or iron based superalloy, or an aluminum alloy.

11. A method according to claim 1, wherein the metal article is a turbine housing unit for a turbocharger of an internal combustion engine, a combustion chamber, a duct for hot gases, or a rocket nozzle or thruster.

* * * * *